US010048020B2

(12) United States Patent
Sperandei et al.

(10) Patent No.: US 10,048,020 B2
(45) Date of Patent: Aug. 14, 2018

(54) HEAT TRANSFER SURFACES WITH FLANGED APERTURES

(71) Applicant: Dana Canada Corporation, Oakville (CA)

(72) Inventors: Bryan Sperandei, Brampton (CA); Bruce Evans, Burlington (CA); Allan K. So, Mississauga (CA); James Scott Cotton, Burlington (CA)

(73) Assignee: Dana Canada Corporation, Oakville (CA)

( * ) Notice: Subject to any disclaimer, the term of this patent is extended or adjusted under 35 U.S.C. 154(b) by 849 days.

(21) Appl. No.: 13/852,212

(22) Filed: Mar. 28, 2013

(65) Prior Publication Data

US 2013/0277029 A1 Oct. 24, 2013

Related U.S. Application Data

(63) Continuation of application No. 11/467,642, filed on Aug. 28, 2006, now Pat. No. 8,453,719.

(51) Int. Cl.

| | |
|---|---|
| ***F28F 1/12*** | (2006.01) |
| ***F28F 3/02*** | (2006.01) |
| ***F28F 13/12*** | (2006.01) |

(52) U.S. Cl.

CPC ..... *F28F 3/02* (2013.01); *F28F 1/128* (2013.01); *F28F 3/027* (2013.01); *F28F 13/12* (2013.01)

(58) Field of Classification Search

CPC ..... F28F 1/325; F28F 2215/08; F28F 3/046; F28F 3/027; F28F 3/02; F28F 1/128

See application file for complete search history.

(56) References Cited

U.S. PATENT DOCUMENTS

| | | | |
|---|---|---|---|
| 1,416,570 | A | 5/1922 | Modine |
| 1,743,861 | A | 1/1930 | Modine |
| 2,222,721 | A | 11/1940 | Ramsaur et al. |
| 3,223,153 | A | 12/1965 | Simpelaar |
| 3,631,922 | A | 1/1972 | Ponziani |
| 3,796,258 | A | 3/1974 | Malhotra et al. |
| 3,804,159 | A | 4/1974 | Searight et al. |
| 4,200,149 | A | 4/1980 | Pechner |
| 4,352,378 | A | 10/1982 | Bergmann et al. |
| 4,593,756 | A | 6/1986 | Itoh et al. |
| 4,727,907 | A | 3/1988 | Duncan |

(Continued)

FOREIGN PATENT DOCUMENTS

| | | |
|---|---|---|
| CA | 484636 A | 7/1952 |
| FR | 995294 | 11/1951 |

(Continued)

OTHER PUBLICATIONS

Extended European Search Report for application 07800510-1605/2064509 PCT/CA2007001484, dated May 8, 2013.

(Continued)

*Primary Examiner* — Tho V Duong

(74) *Attorney, Agent, or Firm* — Marshall & Melhorn, LLC

(57) ABSTRACT

A heat exchanger, turbulizer or heat transfer surface, and a method of making same wherein the turbulizer is a corrugated member having parallel, spaced-apart ridges and planar fins extending therebetween. The planar fins have spaced-apart apertures with opposed peripheral edge portions including transversely extending flanges.

20 Claims, 4 Drawing Sheets

(56) References Cited

U.S. PATENT DOCUMENTS

| | | | | |
|---|---|---|---|---|
| 4,768,583 | A | 9/1988 | Tsukamoto et al. | |
| 4,791,984 | A | 12/1988 | Hatada et al. | |
| 4,817,709 | A | 4/1989 | Esformes | |
| 4,830,102 | A | 5/1989 | Bakay | |
| 4,845,981 | A | 7/1989 | Pearson | |
| 4,963,716 | A | 10/1990 | Van Den Elst et al. | |
| 5,009,263 | A | 4/1991 | Seshimo et al. | |
| 5,029,636 | A | 7/1991 | Kadle | |
| 5,031,693 | A | 7/1991 | VanDyke | |
| 5,056,586 | A | 10/1991 | Bemisderfer | |
| 5,062,474 | A | 11/1991 | Joshi | |
| 5,176,020 | A | 1/1993 | Maruo et al. | |
| 5,184,672 | A | 2/1993 | Aoki | |
| 5,329,994 | A | 7/1994 | Collings et al. | |
| 5,869,912 | A | 2/1999 | Andrew | |
| 6,234,239 | B1 | 5/2001 | Azar | |
| 6,378,605 | B1 | 4/2002 | Kutscher et al. | |
| 6,435,268 | B1 | 8/2002 | Bhatti et al. | |
| 6,729,388 | B2 | 5/2004 | Emrich | |
| 7,028,764 | B2 | 4/2006 | Reagen | |
| 2001/0027857 | A1 | 10/2001 | Emrich et al. | |
| 2004/0099408 | A1 | 5/2004 | Shabtay et al. | |
| 2006/0070726 | A1* | 4/2006 | Yoshioka | F28F 1/128 165/151 |
| 2007/0012430 | A1* | 1/2007 | Duke | F28F 3/027 165/109.1 |

FOREIGN PATENT DOCUMENTS

| | | | | | |
|---|---|---|---|---|---|
| FR | 2872891 | A1 | * | 1/2006 | F28D 1/0435 |
| JP | 55-075190 | | | 6/1980 | |
| JP | 59-56088 | A | | 3/1984 | |
| JP | 02154992 | A | * | 6/1990 | |
| JP | 6129734 | A | | 5/1994 | |
| JP | 0771890 | A | | 3/1995 | |
| JP | 09280762 | A | * | 10/1997 | |
| JP | 09310992 | A | * | 12/1997 | |
| JP | 9310992 | A | | 12/1997 | |
| JP | 09318284 | A | * | 12/1997 | |
| JP | 10185475 | A | * | 7/1998 | |
| JP | 2003161589 | A | * | 6/2003 | |
| WO | 9013785 | A1 | | 11/1990 | |

OTHER PUBLICATIONS

Chinese Office Action for application No. 200780038339.9 dated May 3, 2013 and translation thereof.

* cited by examiner

HEAT TRANSFER SURFACES WITH FLANGED APERTURES

REFERENCE TO PRIOR APPLICATIONS

This application is a continuation of application Ser. No. 11/467,642 filed Aug. 28, 2006, the disclosure of which is incorporated by reference herein in its entirety.

FIELD OF THE INVENTION

This invention relates to heat exchangers, and in particular, to flow augmentation devices, such as fins, turbulizers or turbulators, used to increase heat transfer performance in heat exchangers.

BACKGROUND OF THE INVENTION

In heat exchangers, particularly of the type used to heat or cool liquids such as oil, it is common to use flow augmentation devices to increase mixing or flow turbulence or impede the formation of boundary layers and thus improve the heat transfer efficiency of the heat exchangers. In the past, various types of expanded metal fins or turbulizers have been used. One common type is a corrugated fin where the corrugations are formed with a pattern of slits and the material of the corrugations is displaced laterally to produce offset openings. This produces a serpentine flow path through the turbulizer increasing turbulence and breaking up boundary layers.

Another type of turbulizer is shown in U.S. Pat. No. 4,945,981 issued to Joshi. This patent shows the use of a louvered fin as a turbulizer. Louvered fins are commonly used on the air side of an air to liquid heat exchanger. In this Joshi patent, however, the louvered fin is located inside the heat exchanger tubes or channels that normally contain liquids, such as oils.

Some difficulties with expanded metal or louvered type turbulizers is that they produce undesirably high pressure drops or flow losses in the heat exchanger, or they produce an irregular or non-uniform flow pattern in the heat exchanger passages. This can produce stagnation in some areas of the heat exchanger, but even if this does not occur, a non-uniform flow profile generally indicates less than ideal heat transfer efficiency in the heat exchanger.

SUMMARY OF THE INVENTION

In the present invention, corrugated heat transfer surfaces have a plurality of spaced-apart apertures with opposed peripheral edge portions which include transverse flanges to enhance heat transfer efficiency.

According to one aspect of the invention, there is provided a heat transfer surface for a heat exchanger comprising a corrugated member having parallel, spaced-apart ridges and planar fins extending therebetween. The planar fins are formed with spaced-apart apertures having opposed peripheral edge portions. Also, the opposed edge portions of each aperture include respective flanges that extend transversely from the planar fins.

According to another aspect of the invention, there is provided a heat exchanger comprising a generally flat tube having first and second spaced-apart walls. A corrugated heat transfer surface is located in the tube. The heat transfer surface includes parallel, spaced-apart ridges with planar fins extending therebetween. Alternating ridges are in contact respectively with the first and second walls. The planar fins are formed with spaced-apart apertures having opposed peripheral edge portions. Also, the opposed edge portions of each aperture include respective flanges extending transversely from the planar fins.

According to yet another aspect of the invention, there is provided a method of making a heat transfer surface. The method comprises the steps of providing a sheet of material. The sheet of material is pierced to form spaced-apart, parallel rows of spaced-apart apertures. The apertures have opposed peripheral edge portions including transverse flanges. Also, the sheet is bent transversely along bend lines parallel to the rows of apertures. The bend lines are spaced between the rows of apertures, thereby forming ridges along the bend lines and planar fins extending between the ridges.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
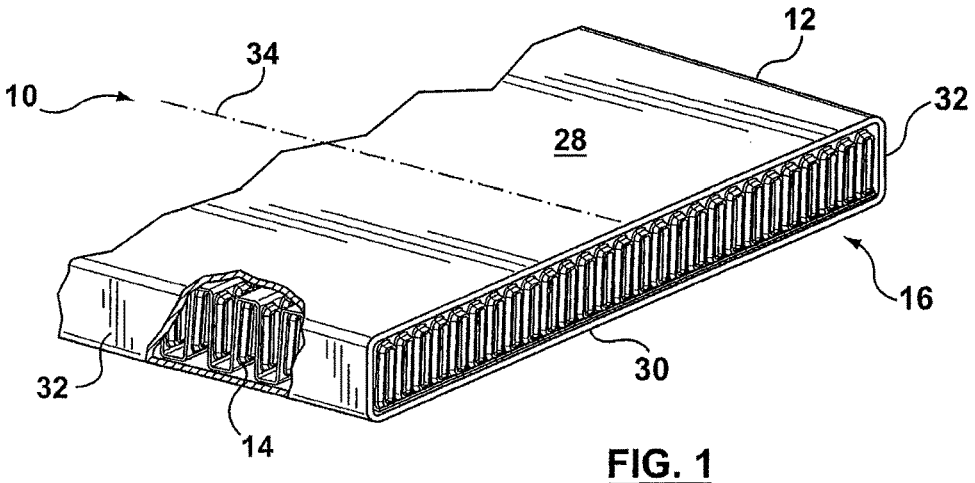
FIG. 1 is a perspective view of a heat exchanger or heat exchanger tube containing a preferred embodiment of a heat transfer surface according to the present invention.

Referring firstly to FIG. 1, a preferred embodiment of a simple exchanger according to the present invention is generally indicated by reference numeral 10. Heat exchanger 10 consists of a single tube 12 containing a turbulizer or heat transfer surface 14, and as such, could be used to heat or cool one fluid flowing through tube 12 transferring heat to or from the ambient fluid surround tube 12. More likely, however, is that tube 12 would be a building block, such that a plurality of such tubes 12 would be stacked vertically in spaced-apart relationship with corrugated fins located between tubes 12. The open ends 16 at each end of tube 12 would either form a respective fluid inlet and outlet for the heat exchanger or would be attached to communicate with manifolds or headers (not shown) to supply fluid to a stack of tubes 12 and receive the fluid from them.

Heat transfer surfaces 14 could also be attached to the outside surfaces of tubes 12, or located between stacked, spaced-apart tubes 12. Where heat transfer surfaces 14 are used inside tubes 12, they are often called turbulizers, because they produce or increase turbulence in the fluid flowing through the tubes. However, depending on the flow velocities, heat transfer surfaces 14 may just cause mixing in the fluid and not actually turbulence. For the purposes of this disclosure, the term "turbulizer" is intended to include heat transfer surfaces that operate in all flow conditions, turbulent or not.

Figure 2:
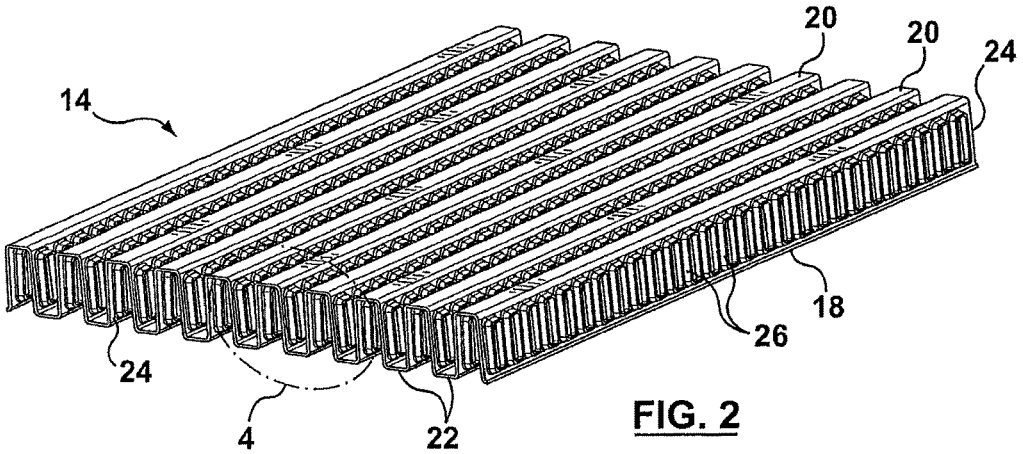
FIG. 2 is a perspective view of the heat transfer surface shown in FIG. 1 taken from the front and from the left side.
Figure 3:
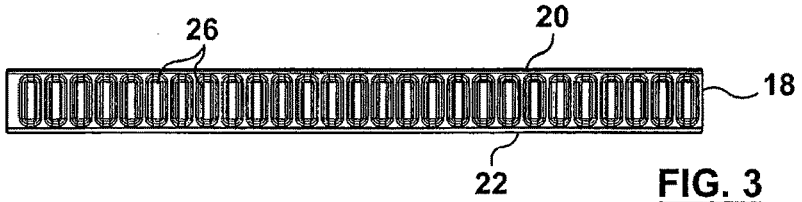
FIG. 3 is a front elevational view of the heat transfer surface shown in FIG. 2.
Figure 4:
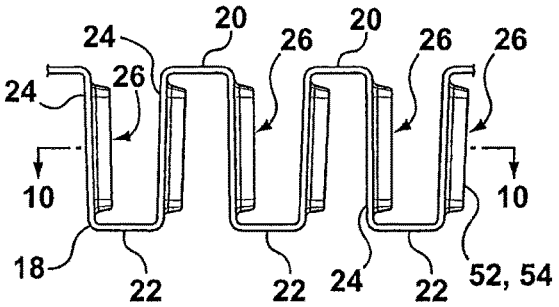
FIG. 4 is an enlarged side elevational view of the portion of FIG. 2 indicated by chain-dotted circle 4.

Referring next to FIGS. 2, 3 and 4, it will be seen that heat transfer surface or turbulizer 14 is a corrugated member 18 having parallel, spaced-apart upper and lower ridges 20, 22, and planar fins 24 extending between the ridges 20, 22. Upper and lower ridges 20, 22 are generally flat in the embodiment shown in FIGS. 2 and 4, and planar fins 24 are generally upright or vertical and parallel. In the embodiment shown, each of the spaced-apart ridges 20, 22 in the heat transfer surface or turbulizer 14 are continuous and in contact with an entire width of the planar fin. In other words, each ridge 20, 22 of the heat transfer surface or turbulizer 14 extends from one peripheral side of the turbulizer 14 to the opposing side without having any breaks or bends, to contact the single tube 12 in which the turbulizer 14 is contained.

Planar fins 24 are formed with a plurality of spaced-apart, "volcano-like" piercings or apertures 26. Apertures 26 are elongated, having a longitudinal axis extending in a direction transverse to ridges 20, 22. Apertures 26 will be described further below in connection with FIGS. 7, 8 and 9.

It will be appreciated that tube 12 as shown in FIG. 1 normally would be an elongate tube having top and bottom or first and second, spaced-apart walls 28 and 30 and longitudinal side walls 32. The turbulizer's upper and lower ridges 20, 22 normally are in contact with the inside surfaces of first and second walls 28, and if heat exchanger 10 is made of aluminum, the turbulizer ridges 20, 22 normally would be brazed to first and second walls 28, 30. As seen in FIG. 1, turbulizer 14 is arranged in tube 12 such that the upper and lower ridges 20, 22 are disposed transversely to the longitudinal axis 34 of tube 12. Flow through tube 12 would thus be perpendicular to ridges 20, 22. This is referred to as the high pressure drop direction of turbulizer 14. The high pressure drop direction is transverse to planar fins 24, and apertures 26 extend in this high pressure drop direction. However, turbulizer 14 also has a low pressure drop direction parallel to planar fins 24. Turbulizer 14 could be turned 90 degrees, so that upper and lower ridges 20, 22 extend parallel to the longitudinal axis 34 of tube 12. Apertures 26 would then extend transversely to the longitudinal flow direction through tube 12. Where fins 24 are upright and parallel, or perpendicular to the tube walls 28, 30, flow through the apertures 26 would be generally perpendicular or normal to the fins 24 as well.

Figure 5:
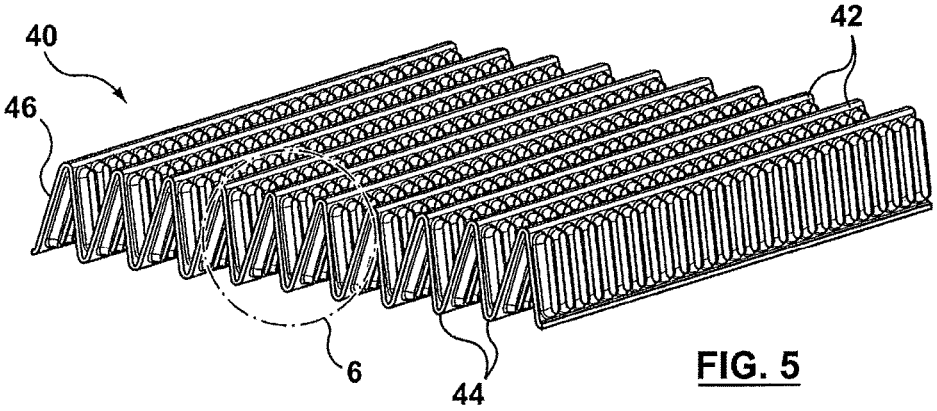
FIG. 5 is a perspective view similar to FIG. 2, but showing another preferred embodiment of a heat transfer surface according to the present invention.
Figure 6:
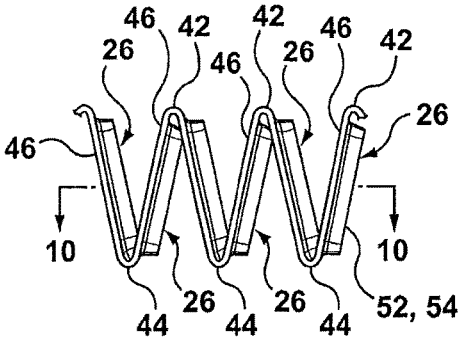
FIG. 6 is an enlarged side elevational view of the portion of FIG. 5 indicated by chain-dotted circle 6.

Referring next to FIGS. 5 and 6, a heat transfer surface or turbulizer 40 is shown which is similar to turbulizer 14, except that the upper and lower spaced-apart ridges 42, 44 are rounded and the planar fins 46 are inclined with respect to one another. The fins thus would also be inclined with respect to tube walls 28, 30.

Figure 7:
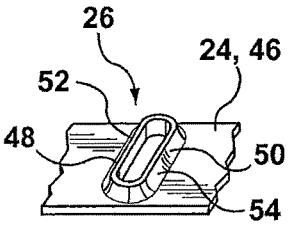
FIG. 7 is a perspective view of a preferred configuration of a fin aperture according to the present invention.
Figure 8:
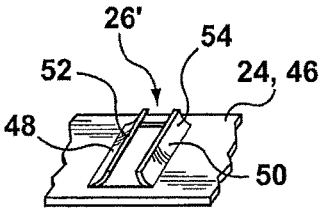
FIG. 8 is a perspective view of another preferred configuration of a fin aperture according to the present invention.
Figure 9:
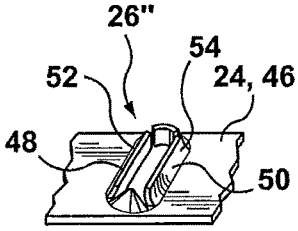
FIG. 9 is a perspective view of yet further preferred configurations of fin apertures according to the present invention.
Figure 10:
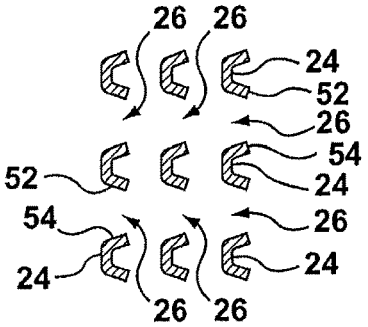
FIG. 10 is a diagrammatic, cross-sectional view taken along lines 10-10 of either FIG. 4 or FIG. 6.

Referring next to FIGS. 7, 8 and 9, apertures 26 have opposed peripheral edge portions 48, 50, and the peripheral edge portions defining each of the plurality of spaced-apart apertures being only on the planar fin and avoiding contacting the spaced-apart ridges. Peripheral edge portions 48, 50 have respective flanges 52, 54 that extend transversely from planar fins 24, 46. In FIGS. 7 to 9, the transverse flanges 52, 54 associated with each aperture 26 are angled slightly with respect to one another. However, transverse flanges 52, 54 could be made perpendicular to planar fins 24, 46. Even where the flanges 52, 54 are angled with respect to one another as shown in FIGS. 7 to 9, the flanges are considered to be generally perpendicular to the planar fins 24, 46 for the purposes of this specification.

In FIG. 7, it will be seen that the flanges associated with apertures 26 are continuous around the periphery of the apertures 26. This configuration is what gives rise to the reference to apertures 26 as being "volcano-like" as mentioned above. In FIGS. 8 and 9, the flanges associated with each aperture 26' and 26" are split or interrupted around the periphery of the apertures. This results from the method of forming the apertures, as will be described further below.

Figure 23:
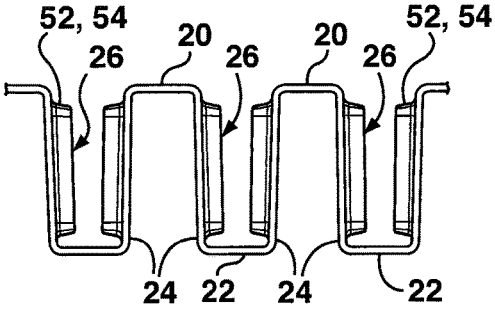
FIG. 23 is an enlarged side elevational view of a portion of the heat transfer surface according to an alternate embodiment of the present invention.

In the embodiments shown in FIGS. 4 and 6, all of the apertures 26, or at least the flanges 52, 54, extend in the same direction in the turbulizer. As mentioned above, flow through these apertures is referred to as being in the high pressure drop direction. Actually, the pressure drop where the flow is from right to left in FIGS. 4 and 6 is slightly higher than where the flow is from left to right. In the embodiment shown in FIG. 4, the flanges 52, 54 on alternating planar fins 24 could extend in opposite directions in the turbulizer as shown for example in FIG. 23. This could also be done in the FIG. 6 embodiment if the fins 24 are spaced far enough apart that the flanges 52, 54 would not interfere with one another in adjacent fins. Where the flanges 52, 54 extend in opposite directions in alternating planar fins 24, the pressure drop would be the same going either way in the high pressure drop direction. Turbulizers 14 and 40 could be located inside tubes 12, so that the flow through the turbulizers is in either direction through apertures 26.

Figure 11:
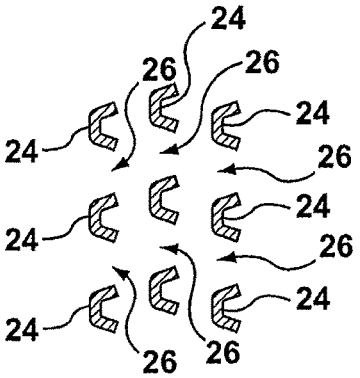
FIG. 11 is a diagrammatic, cross-sectional view similar to FIG. 10, but showing the fin apertures slightly offset.
Figure 12:
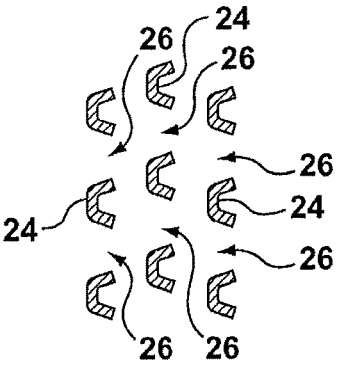
FIG. 12 is a diagrammatic, cross-sectional view similar to FIG. 11, but showing the fin apertures offset a bit more.
Figure 13:
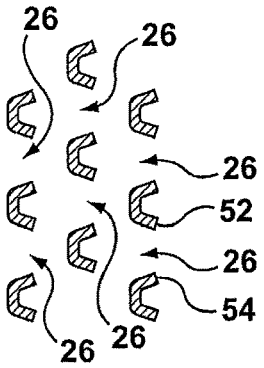
FIG. 13 is a diagrammatic, cross-sectional view similar to FIGS. 11 and 12, but showing the fin apertures fully offset.

Referring next to FIGS. 10 to 13, FIG. 10 corresponds to the arrangement of the apertures as indicated in FIGS. 2 and 5, where all of the apertures 26 are aligned in the longitudinal direction of heat exchanger tube 12. Apertures 26 are thus aligned in the high pressure drop direction of heat exchanger 10 and some part of the flow through tubes 12 can pass straight through the apertures 26. In FIG. 11, the apertures 26 are slightly offset from the apertures 26 in the next adjacent planar fin 24. In FIG. 12, the apertures 26 are even more offset in respect of the apertures 26 in the next adjacent planar fins 24, and in FIG. 13, apertures 26 are fully offset. In the embodiments shown in FIGS. 11 to 13, flow through turbulizers 14 and 40 would take on an increasingly serpentine flow path from FIG. 11 to FIG. 13. It will be appreciated that apertures 26 can be aligned or offset when the turbulizers 14, 40 are orientated in either the high or low pressure drop direction in the heat exchanger or tubes 12.

Figure 14:
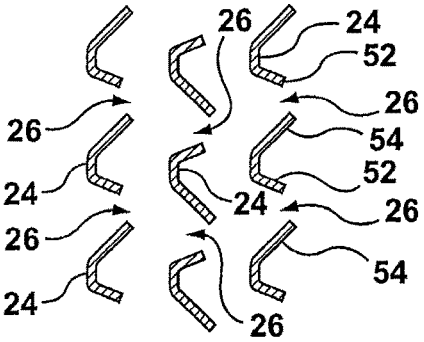
FIG. 14 is a diagrammatic, cross-sectional view similar to FIG. 10, but showing the fin apertures having flanges of different widths and angles.
Figure 15:
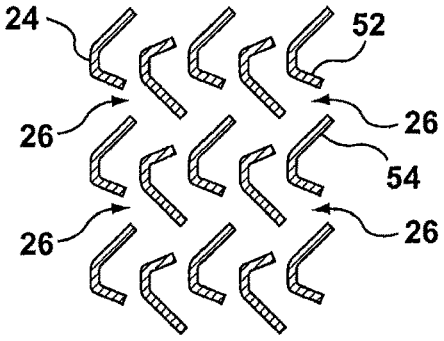
FIG. 15 is a diagrammatic, cross-sectional view similar to FIG. 14, but showing offset fin apertures and a higher fin density.

FIG. 14 illustrates that the flanges 52, 54 associated with each aperture 26 could be disposed at different angles relative to planar fins 24. Further, the flanges 52, 54 associated with each aperture 26 could be of different length, width or height. Similarly, the flanges associated with different apertures could also be of different length, width or height. Further, the apertures 26 could be other shapes, such as diamond, triangular or circle shapes, and spaced differently, as described further below. The apertures in planar fins 24 could also be located in spaced-apart groups. FIG. 15 illustrates that the fin and aperture density could also be varied, if desired, FIG. 15 having more fins and apertures than previously described embodiments, and thus having a higher fin and aperture density.

Figure 16:
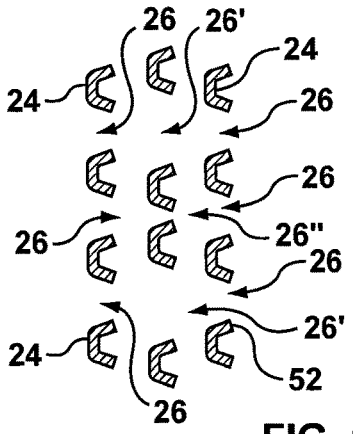
FIG. 16 is a diagrammatic, cross-sectional view similar to FIG. 10 showing fin apertures of different widths or sizes.

FIG. 16 is similar to FIGS. 10 to 13, but it shows that some of the apertures 26' could be wider or larger than apertures 26, and some of the apertures 26" could be narrower or smaller than apertures 26. In FIG. 16, every other fin has these larger and smaller apertures 26' and 26".

Figure 17:
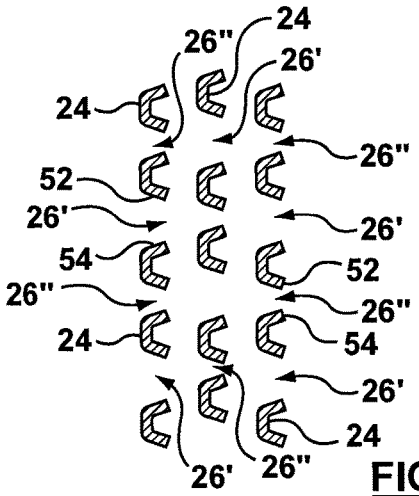
FIG. 17 is a diagrammatic, cross-sectional view similar to FIG. 10 showing another embodiment with fin apertures of different sizes and spacing.

In FIG. 17, the apertures in alternating fins 24 are of different sizes, and are also spaced apart differently in adjacent planar fins 24.

Figure 18:
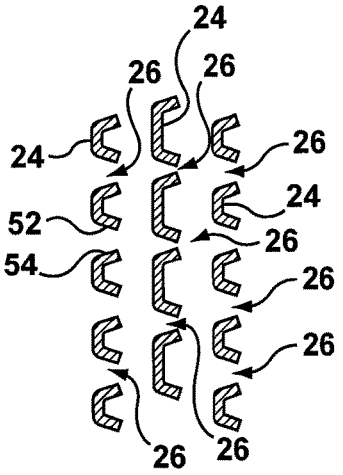
FIG. 18 is a diagrammatic, cross-sectional view similar to FIG. 10 showing yet another embodiment with fin apertures of both different sizes and different spacing.

FIG. 18 shows that the apertures 26, can be spaced apart differently in adjacent or alternating planar fins 24.

Figure 19:
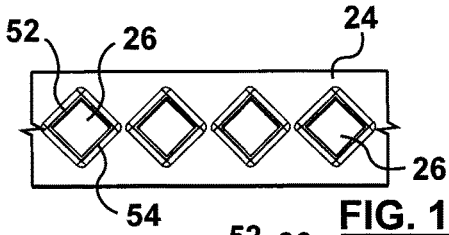
FIG. 19 is a plan view of a portion of a fin showing diamond-shaped apertures.

FIG. 19 shows that the apertures 26 could be diamond shaped or square in plan view.

Figure 20:
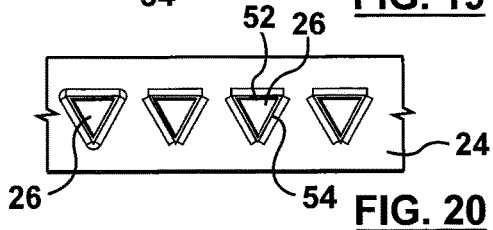
FIG. 20 is a plan view similar to FIG. 19 showing triangular-shaped apertures.

FIG. 20 shows that the apertures 26 could be triangular shaped. Preferably the apertures in alternating rows would be inverted (not shown).

Figure 21:
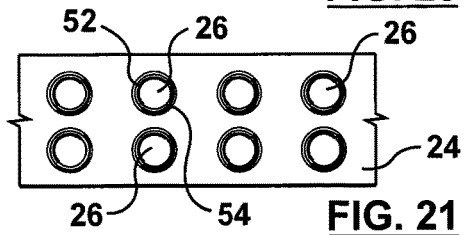
FIG. 21 is a plan view similar to FIG. 19 showing circular apertures.

FIG. 21 shows that the apertures 26 could be circular in shape. Although two rows of apertures 26 are shown in fins 24, a single row of apertures 26 could be provided as well.

Figure 22:
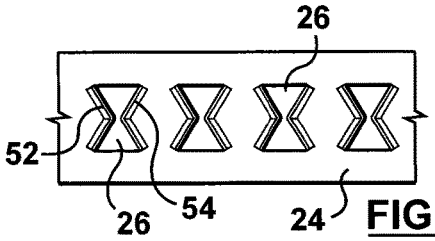
FIG. 22 is a plan view similar to FIG. 19 showing hourglass-shaped apertures.

FIG. 22 shows that apertures 26 could be hourglass shaped.

It will be appreciated that the aperture shapes and sizes shown in the drawings could be mixed and matched as desired, as could the size and spacing of the apertures, to give any particular flow pattern desired through the heat transfer surfaces 14.

The method of making heat transfer surfaces or turbulizers 14 and 40 is to first start with a sheet of material, such as aluminum, copper or stainless steel. The sheet of material would then be pierced to form spaced-apart, parallel rows of spaced-apart apertures. In the case of the embodiments shown in FIGS. 7 to 9, the apertures could start by making a slit and then expanding the slit to form the peripheral flanges 52, 54. If the material is soft enough, or the apertures are small enough, a continuous peripheral flange could be formed as indicated in FIG. 7. If the material is more brittle or the apertures are larger, an aperture 26" would be formed as indicated in FIG. 9 wherein the aperture peripheral flanges split and become discontinuous or jagged during formation. FIG. 9 shows two different shapes (square and triangular) for the end portions of the peripheral flanges. Normally, it would be one or the other for both end portions, but they could be different, as indicated. In the FIG. 8 embodiment, an H-type slit would be made in the material and the slit opened up or expanded to form the opposed peripheral flange portions 52, 54. Where the apertures 26 are other shapes, such as are shown in FIGS. 19 to 22, appropriate piercings would be made, so that when opened up, these shapes would be produced.

Once the apertures are formed in the desired configuration, the sheet of material is then bent along lines parallel to the rows of apertures. The bend lines would be spaced between the rows of apertures, thereby forming the ridges 20, 22 or 42, 44 along the bend lines and the planar fins 24 extending between the ridges. In some embodiments, as shown in FIGS. 4, 10-18, and 23, the flanges 52, 54 avoid contact with another surface to allow for a fluid to pass through and mix, which can help to augment flow and can be used to increase heat transfer performance.

To form the embodiment shown in FIG. 5, the sheet of material would be bent in opposite transverse directions on alternating bend lines. To make the embodiment shown in FIG. 2, the sheet would be bent along two parallel bend lines between each row of apertures 26, thereby forming the ridges 20, 22 with generally flat peaks. The sheet in the FIG. 2 embodiment would be bent in the same transverse direction along the parallel bend lines between alternating rows of apertures 26, or this double bend could be produced between only some of the adjacent rows of apertures 26, with the sheet being bent along a single bend line between other adjacent rows of apertures 26, thus producing a combination of the configurations shown in FIGS. 2 and 5.

Normally, the slitting of the sheet of material and the formation of the flanged apertures 26 is done in a single operation. The sheet can be pierced in the same transverse direction for all the apertures, or the sheet can be pierced in opposite transverse directions in adjacent rows of apertures. The sheet of material may be pierced and bent simultaneously, or in separate operations.

As mentioned above, the sheet of material can be pierced to form spaced-apart groups of apertures in each row of apertures. Further, the sheet could be pierced in opposite transverse directions in adjacent groups of apertures in each row of apertures. If the sheet material is soft enough, the sheet material may be stretched while the apertures are being pierced, thereby producing flanges 52, 54 that are elongated or wider or higher than normally would be the case. As indicated above, the apertures 26 are typically elongate having a longitudinal axis extending in a transverse direction to the ridges 20, 22 and 42, 44. However, the apertures could be round, circular, triangular, diamond or some other shape if desired, as indicated in FIGS. 19 and 22.

If it is desired to have the planar flanges 24 closer together, the turbulizer could be gathered together after the sheet is bent transversely along the bend lines. In the embodiment shown in FIG. 4, the planar fins 24 could be angled with respect to one another and with respect to the first and second walls 28, 30 of tubes 12, or they could be substantially perpendicular and parallel. In forming the turbulizer shown in FIG. 4, the sheet of material could be bent until the planar fins 24 are angled, and then the turbulizer gathered together to make the planar fins parallel to one another.

Having described preferred embodiments of the invention, it will be appreciated that various modifications may be made to the structures described above. For example, both types of heat transfer surfaces 14 and 40 could be used in the same tube 12, and they could be orientated differently, so that some of them are in the high pressure drop direction and some of them are in the low pressure drop direction. Flanges 52, 54 could extend in opposite directions in different sections or in different planar fins 24 of the heat transfer surfaces, or portions of same, to vary the pressure drop as desired. Multiple sections of a same type of heat transfer surface could be used in each tube 12, again with some of them orientated in the high pressure drop direction and some of them orientated in the low pressure drop direction. Further, two or more layers of heat transfer surfaces could be located in each tube 12, again with the type and orientation mixed and matched, as desired. Also, the heat transfer surfaces of this invention could be used between the tubes, and they could be used in air-to-air type heat exchangers to increase mixing or turbulence in the fluids flowing through or around the heat exchangers. Finally, the tubes 12, need not be tubes in the strict sense. They could be formed of mating plate pairs, or a pan and cover construction, or some other structure, as desired.

From the foregoing, it will be evident to persons of ordinary skill in the art that the scope of the present invention is limited only by the accompanying claims, purposively construed.

The invention claimed is:

1. A heat transfer surface for a heat exchanger comprising:

a corrugated member having parallel, spaced-apart ridges and planar fins extending therebetween; wherein each of the spaced-apart ridges being continuous and in contact with an entire width of the planar fin;

each planar fin being formed with a plurality of spaced-apart apertures, each aperture having opposed peripheral edge portions; the peripheral edge portions defining each of the plurality of spaced-apart apertures being only on the planar fin and avoiding contacting the spaced-apart ridges;

said opposed edge portions of each aperture including respective flanges that extend outwardly from a single side of the planar fin forming said aperture and terminate at a free end;

wherein the apertures are elongated, having a longitudinal axis extending in a direction transverse to the ridges;

wherein the flanges associated with each aperture extend outwardly from the single side of the planar fin and are angled relative to the planar fin, each flange forming an obtuse angle with the planar fin and avoiding contact with another surface, and wherein the heat transfer surface is disposed such that:

the ridges are disposed perpendicular and the planar fins are disposed normal with respect to incoming fluid flow; and the apertures and the flanges are cooperatively configured for conducting incoming fluid therethrough such that the incoming fluid travels directly through the apertures.

2. A heat transfer surface as claimed in claim 1 wherein the flanges associated with each aperture are continuous around the periphery of the aperture.

3. A heat transfer surface as claimed in claim 1 wherein the flanges associated with each aperture are interrupted around the periphery of the aperture.

4. A heat transfer surface as claimed in claim 1 wherein the heat transfer surface has a low pressure drop direction parallel to the planar fins and a high pressure drop direction transverse to the planar fins, and wherein the apertures are aligned in the high pressure drop direction.

5. A heat transfer surface as claimed in claim 1 wherein the heat transfer surface has a low pressure drop direction parallel to the planar fins and a high pressure drop direction transverse to the planar fins, and wherein the apertures are offset in the high pressure drop direction.

6. A heat transfer surface as claimed in claim 1 wherein the flanges all extend in the same direction in the heat transfer surface.

7. A heat transfer surface as claimed in claim 1 wherein the flanges on alternating planar fins extend in opposite directions in the heat transfer surface.

8. A heat transfer surface as claimed in claim 1 wherein the planar fins are inclined with respect to one another.

9. A heat transfer surface as claimed in claim 1 wherein the planar fins are parallel to one another.

10. A heat transfer surface as claimed in claim 1 wherein the flanges associated with each aperture are disposed at different angles relative to the planar fins.

11. A heat transfer surface as claimed in claim 1 wherein the flanges associated with each aperture are of different widths.

12. A heat transfer surface as claimed in claim 1 wherein the apertures in each planar fin are located in spaced-apart groups.

13. A heat transfer surface as claimed in claim 1 wherein the apertures are different shapes.

14. A heat transfer surface as claimed in claim 1 wherein the apertures are different sizes.

15. A heat transfer surface as claimed in claim 1 wherein the apertures are spaced apart differently in adjacent planar fins.

16. A heat transfer surface for a heat exchanger, comprising:

a corrugated member having parallel, spaced-apart ridges and planar fins extending therebetween; wherein each of the spaced-apart ridges being continuous and in contact with an entire width of the planar fin;

each planar fin being formed with a plurality of spaced-apart apertures for the flow of a fluid therethrough, wherein the apertures are elongated, having a longitudinal axis extending in a direction transverse to the ridges;

each aperture having opposed peripheral edge portions; the peripheral edge portions defining each of the plurality of spaced-apart apertures being only on the planar fin and avoiding contacting the spaced-apart ridges;

said opposed edge portions including respective flanges that extend outwardly from a single side of the planar fin forming said aperture and terminate at a free end, the free ends defining an opening therebetween that is smaller than the associated aperture formed in the planar fin, and wherein the flanges avoid contact with another surface, and wherein the heat transfer surface is disposed such that:

the ridges are disposed perpendicular and the planar fins are disposed normal with respect to incoming fluid flow; and the apertures and the flanges are cooperatively configured for conducting incoming fluid therethrough such that the incoming fluid travels directly through the apertures.

17. A heat transfer surface as claimed in claim 16 wherein the flanges associated with each aperture are continuous around the periphery of the aperture, the flanges forming a volcano-like structure.

18. A heat transfer surface as claimed in claim 16 wherein the heat transfer surface has a low pressure drop direction parallel to the planar fins and a high pressure drop direction transverse to the planar fins, and wherein the apertures are aligned in the high pressure drop direction.

19. A heat transfer surface as claimed in claim 16 wherein the heat transfer surface has a low pressure drop direction parallel to the planar fins and a high pressure drop direction transverse to the planar fins, and wherein the apertures are offset in the high pressure drop direction.

20. A heat transfer surface as claimed in claim 16 wherein the planar fins are one of: inclined with respect to one another, or parallel to one another.

* * * * *